US006786808B1

(12) United States Patent
Biagiotti

(10) Patent No.: US 6,786,808 B1
(45) Date of Patent: Sep. 7, 2004

(54) SHARPENING DEVICE FOR ROTATING CUTTING TOOLS AND MACHINE EMPLOYING SAID DEVICE

(75) Inventor: Guglielmo Biagiotti, Lucca (IT)

(73) Assignee: Fabio Perini S.p.A., Lucca (IT)

( * ) Notice: Subject to any disclaimer, the term of this patent is extended or adjusted under 35 U.S.C. 154(b) by 7 days.

(21) Appl. No.: 10/129,749

(22) PCT Filed: Nov. 3, 2000

(86) PCT No.: PCT/IT00/00440

§ 371 (c)(1),
(2), (4) Date: May 9, 2002

(87) PCT Pub. No.: WO01/36151

PCT Pub. Date: May 25, 2001

(30) Foreign Application Priority Data

Nov. 17, 1999 (IT) ..... FI99A0236

(51) Int. Cl.[7] ..... B24B 7/00; B26D 7/12

(52) U.S. Cl. ..... 451/196; 451/72; 451/185; 451/192; 451/443; 83/174

(58) Field of Search ..... 451/56, 70, 72, 451/185, 192, 193, 196, 443; 83/174

(56) References Cited

U.S. PATENT DOCUMENTS

| | | | | |
|---|---|---|---|---|
| 2,033,939 A | | 3/1936 | Jeppsson | |
| 2,119,760 A | | 6/1938 | Weiner et al. | |
| 4,041,813 A | | 8/1977 | Spenser | |
| 4,584,917 A | | 4/1986 | Blom | |
| 6,110,019 A | * | 8/2000 | Ohmori | 451/56 X |
| 6,123,002 A | * | 9/2000 | Wunderlich et al. | 83/174 X |

FOREIGN PATENT DOCUMENTS

| | | |
|---|---|---|
| DE | 930 560 C | 7/1955 |
| DE | 1 016 175 B | 9/1957 |
| EP | 0 507 750 A1 | 7/1992 |
| EP | 0 609 668 B1 | 9/1998 |
| FR | 2 688 731 A1 | 9/1993 |
| GB | 1 525 855 A | 9/1978 |

* cited by examiner

*Primary Examiner*—Charles Goodman
(74) *Attorney, Agent, or Firm*—Breiner & Breiner, L.L.C.

(57) ABSTRACT

A device for sharpening a rotating discoidal cutting tool (13) is described, comprising at least one sharpening grinder (21; 23). The device provides a dressing tool (61; 71) which interacts with said at least one grinder to dress the working surface of said grinder.

19 Claims, 5 Drawing Sheets

SHARPENING DEVICE FOR ROTATING CUTTING TOOLS AND MACHINE EMPLOYING SAID DEVICE

TECHNICAL FIELD

The present invention relates to a sharpening device for sharpening a rotating discoidal cutting tool. The invention also relates to a machine comprising such a device and, in particular, a severing machine for cutting off rolls of wound-up web material.

PRIOR ART

In many sectors of industry, machines are used for cutting materials of various types by means of discoidal cutting tools which rotate about their own axis. In particular, machines of this type are used in the paper and board converting industry and, in general, in the paper making sector.

In certain cases, the tools are used for the lengthwise cutting of a strip of paper material which is fed continuously, for example downstream of a board production plant, along the path on which the paper is wound into reels, or in other similar situations.

In the sector of the production of rolls of toilet paper, paper towels and other products in roll form, machines are used that are known as severing machines and have the function of cutting rolls or what are referred to as logs of great length transversely to their axis to reduce them to small rolls of dimensions corresponding to the dimensions of the finished product Severing machines of this type are described, for example, in EP-A-0 507 750, EP-A-0609 668 and U.S. Pat. No. 4, 041, 813.

In these various types of machine, it is necessary to undertake regular sharpening of the cutting edge of the cutting tool or tools. To this end, use is made of sharpening assemblies which normally comprise two grinders acting on the two flanks of the tool. The grinders may be motor-driven, for example by means of a hydraulic or pneumatic motor, or non-driven and rotated by friction by the movement of the cutting tool.

OBJECTS AND SUMMARY OF THE INVENTION

An object of the present invention is the production of a sharpening device for rotating discoidal cutting tools, in particular but not exclusively for web material, and especially material wound into rolls, which device is more efficient than the conventional devices.

Another object of the present invention is the production of a device of the abovementioned type which makes it possible to obtain more efficient sharpening and to lengthen the service life of the sharpening grinder or grinders.

These and other objects and advantages, which will be clearly apparent to those skilled in the art from a reading of the text that follows, are substantially achieved by means of a device for sharpening a rotating discoidal cutting tool, comprising at least one sharpening grinder, especially a rotating circular grinder, characterized by at least one dressing tool which interacts with the grinder to dress the working surface of said grinder, during the sharpening or between successive sharpenings of the cutting tool.

In this manner, the efficiency of the grinder and hence of the sharpening device is increased and better use is made of the grinder, its operating life being increased. Furthermore, the need to undertake manual dressing of the grinder, which would require the stopping of the sharpening device and, consequently, of the machine to which the device is fitted, is avoided. By avoidance of manual intervention, the serious risk of accidents caused by the closeness of the operator to the cutting tool is also avoided.

The grinder may be single or double for each tool. In the second case, the two grinders act on the two flanks of the cutting edge of the tool. In certain cases, it is also possible to provide two grinders on the same flank, acting on different portions of the flank of the tool, for example in order to obtain a cutting bevel of a particular shape. In all cases it is possible to provide, for each grinder or for only some of them, a dressing tool. For example, if two grinders are provided for each flank of the cutting tool, it is possible to provide a dressing tool for only one of the grinders or for both.

In a manner known per se, in accordance with a particularly advantageous embodiment of the device, the grinder or each grinder possesses a first actuator to move the grinder into an active position in which it acts on the cutting tool and into an idle position in which it is withdrawn from the cutting tool.

The dressing tool or each dressing tool preferably possesses a second actuator for moving said dressing tool alternately into an active position, in which it acts on said grinder, and into an idle position, in which it is withdrawn from the grinder.

With this arrangement, it is possible to move the grinder alternately into and out of operation, and the same can be done for the dressing tool, irrespective of the position of the grinder.

As mentioned above, the grinder or grinders may be motor-driven. According to a preferred embodiment, however, the grinder or grinders is or are supported on a non-driven shaft and are rotated by the action of friction when they come into contact with the rotating cutting tool. As regards the manner in which the grinders are motor-driven, also, if a plurality of grinders are provided in the same device they may all be non-driven, or motor-driven or some non-driven and some motor-driven.

When the grinder is mounted on a non-driven shaft, a rotation system may be associated therewith, facilitating the rotation thereof, in conjunction with the entrainment effect exercised by the cutting tool. For example, according to a possible embodiment, vanes fixed to the grinder may be provided, on which vanes acts a jet of air generated by one or more nozzles. The vanes and the nozzle or nozzles are oriented so as to urge the respective grinder to rotate in the same direction as that in which it is urged to rotate by the action of the cutting tool when the grinder is in contact with the latter.

This arrangement, or another appropriate system of rotation, makes it possible to obtain two results: on the one hand, dressing of the grinder is allowed even when the latter is not in contact with the cutting tool. This is particularly useful when the dressing operations have to be performed in whole or in part, with the grinder in the non-working position. Secondly, when the grinder is in operation, the system of rotation applies a driving torque to the grinder which is added to the torque deriving from the friction with the cutting tool and prevents the rotation of the grinder being stopped by the opposing torque applied by the dressing tool. If this were to happen during a sharpening operation it would cause the formation of steps in the working surface of the grinder.

In order to reduce or eliminate the scattering of chips caused by the sharpening and/or dressing, and also in order to avoid the risks of fire caused by the sparks given off during the sharpening phase, according to a particularly advantageous embodiment of the device, the grinder or grinders and the dressing tool or tools are accommodated in a containment housing. The housing is connected to a suction pipe and possesses a slit into which said cutting tool partially penetrates. This containment system may also be applied to a sharpening device without dressing tools. It is, however, advantageous in the case in which dressing tools are provided, in that, in this case, it is unnecessary to access the grinders at intervals in order to dress them and therefore the latter can be accommodated in a housing.

The invention also relates, in particular, to a severing machine for cutting rolls or logs of web material into small rolls, comprising at least one rotating discoidal cutting tool and an associated sharpening device, made as stated above.

More generally, the invention relates to, a cutting device comprising at least one rotating discoidal cutting tool and an associated device for sharpening said cutting tool, made as defined above.

BRIEF DESCRIPTION OF THE DRAWINGS

The invention will be better understood with reference to the description and the attached drawing, which shows a possible non-limiting embodiment of the invention. More particularly.

DETAILED DESCRIPTION OF AN EMBODIMENT OF THE INVENTION

Figure 1:
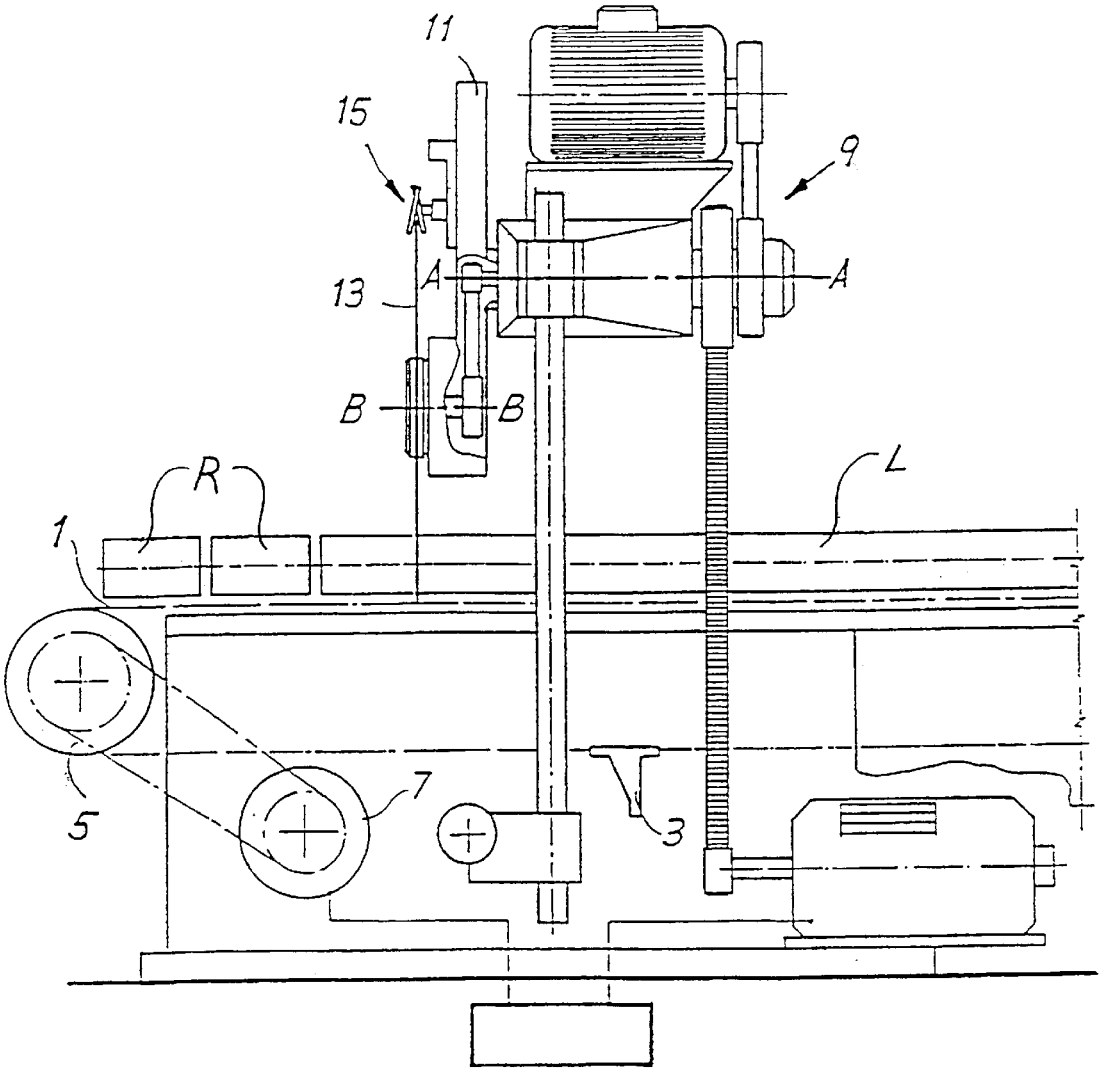
FIG. 1 shows a diagram of a severing machine to which the sharpening device according to the invention can be fitted.

FIG. 1 shows diagrammatically a severing machine, limited to its essential components. The reference 1 generically designates an endless flexible member to which are applied thrusters 3 which exert pressure on a roll or log which is to be cut into small rolls R of lesser axial length. The flexible member 1 is passed around two deflection pulleys, one of which is visible in FIG. 1 and designated therein by 5. The wheel is actuated by a motor 7. The reference 9 generically indicates the head of the severing machine, which bears a plate 11 rotating about an axis A—A on which is mounted a rotating discoidal cutting tool 13, which rotates about an axis B—B. The severing machine shown is solely by way of example and, as will become apparent from the description that follows, its specific structure is not binding for the purposes of implementing the present invention.

Applied to the rotating plate 11 is a sharpening device 15 of which FIG. 1 merely indicates the grinders diagrammatically. The sharpening device is the subject of the present invention and will be described in more detail in the text that follows.

Figure 2:
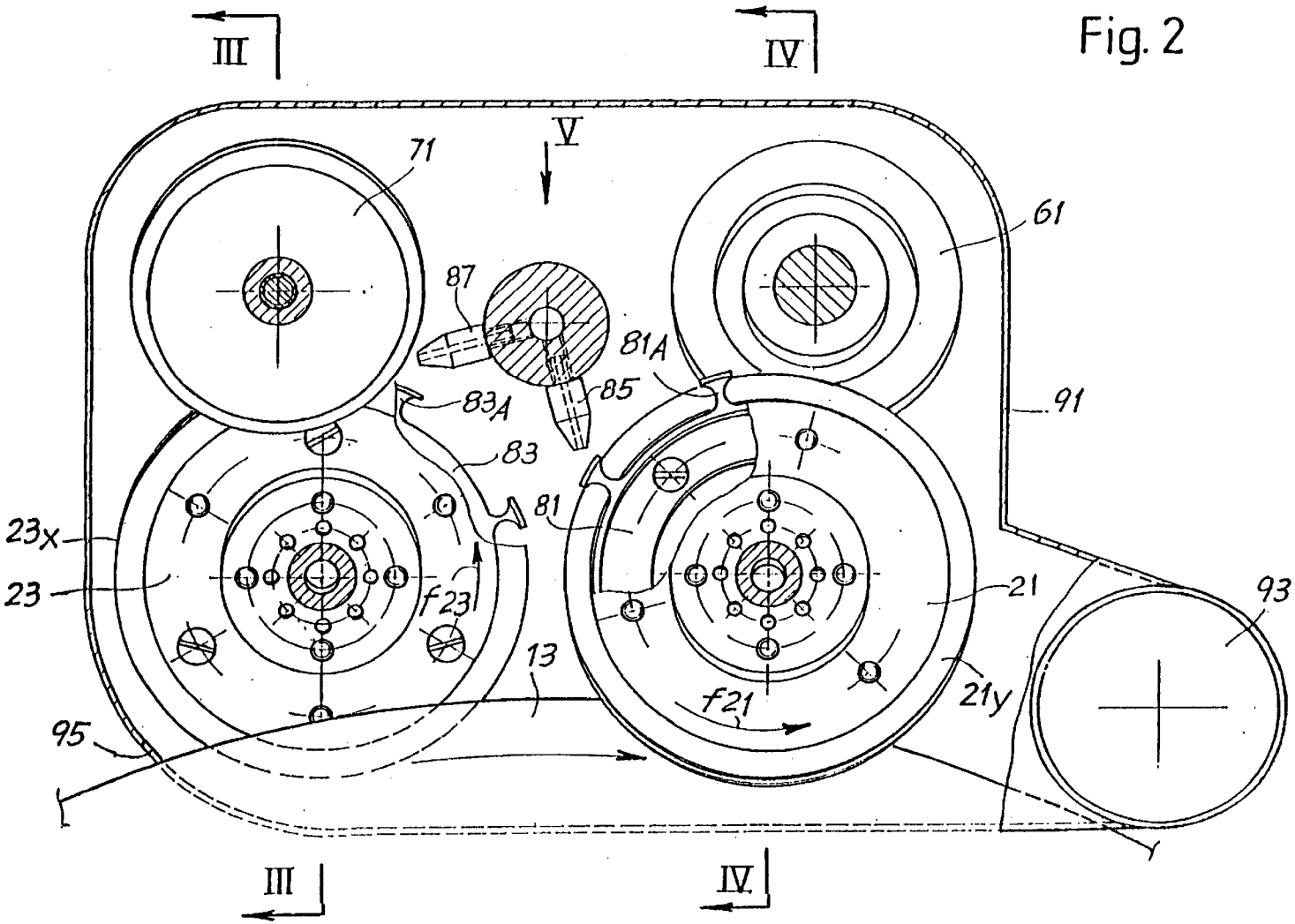
FIG. 2 shows a section through the sharpening assembly along the line II—II in FIGS. 3 and 4.
Figure 3:
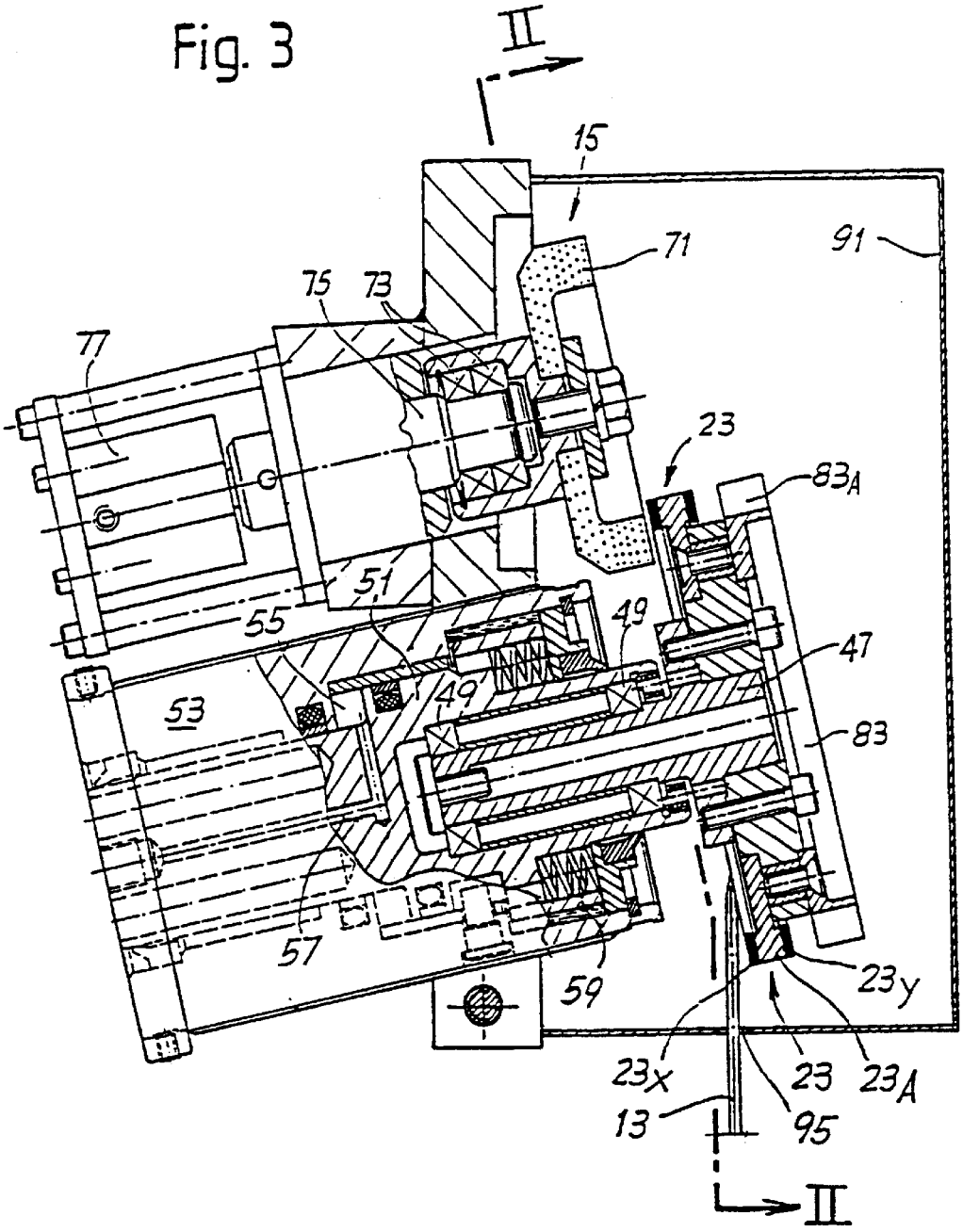
FIGS. 3 and 4 show sections along the lines III—III and IV—IV respectively in FIG. 2.
Figure 4:
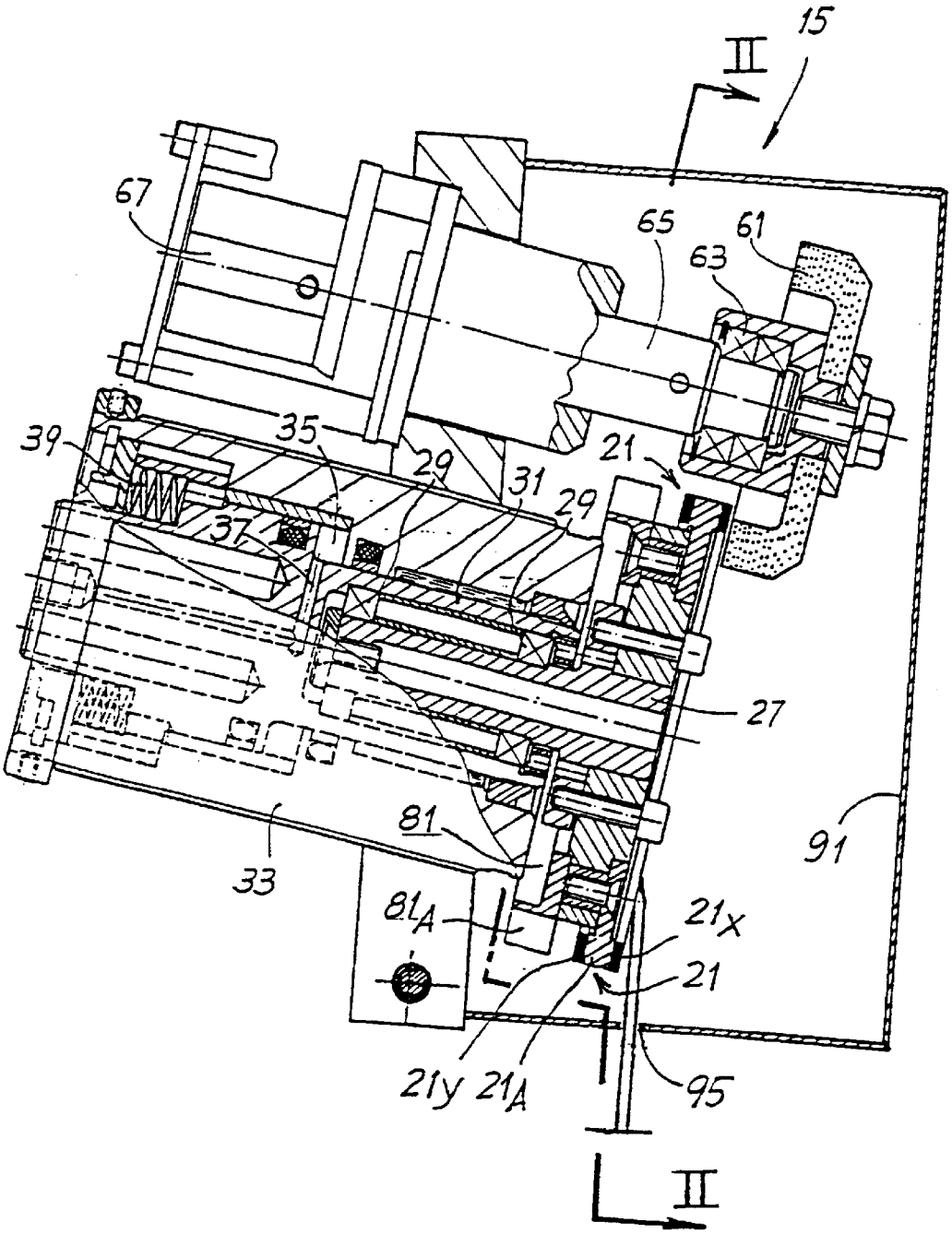
Figure 5:
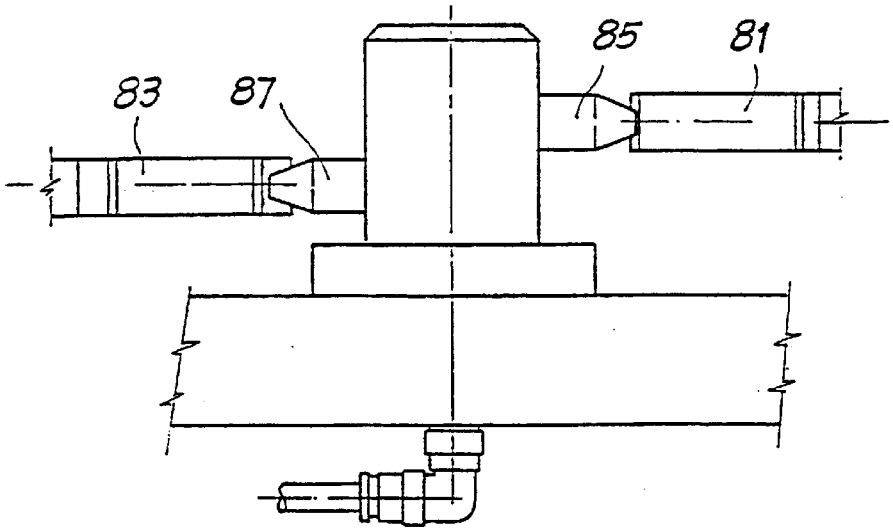
FIG. 5 shows a plan view in the direction of the arrow V in FIG. 2 of the actuating nozzles of the grinder.
Figure 6:
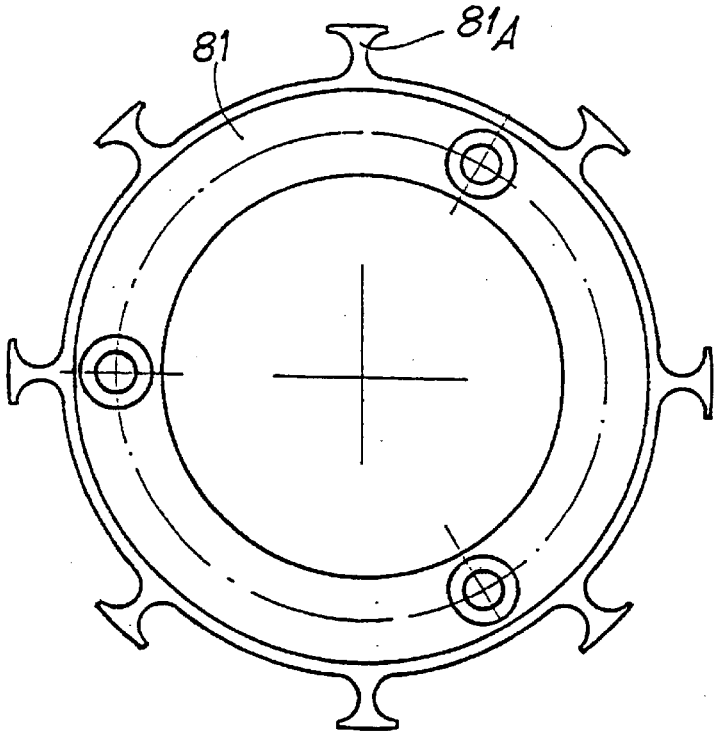
FIG. 6 shows an axial view of one of the collars equipped with sets of vanes fixed to the sharpening grinders.

As can be seen in FIGS. 2, 3 and 4, the sharpening device 15 possesses two grinders 21 and 23 which act on opposite flanks of the cutting tool 13. The grinder 21 is carried by a spindle 27 mounted to rotate freely on bearings 29. The bearings 29 are mounted in a unit 31 which is axially sliding, to a small extent, within a seating made in a support assembly 33 mounted in a fixed manner relative to the plate 11 to which the sharpening device 15 is applied. The reference 35 indicates a chamber into which a fluid under pressure is fed via a pipe 37 to urge the unit 31 and hence the grinder 21 to move away from the cutting tool 13. The opposite movement is obtained by a loading spring 39 or other resilient member accommodated within the support assembly. In substance, then, the unit 31 and the support assembly 33 form a single-acting cylinder-piston actuator which serves to move the grinder alternately into a working position and into a withdrawn or non-working position in which the latter does not touch the cutting tool. The travel of the spring may be limited to a few millimeters or even to a few tenths of a millimeter to move from one position into the other.

The grinder 23 is mounted, similarly to the grinder 21,on a spindle 47 mounted to rotate freely in bearings 49. The bearings 49 are mounted in a unit 51 which is axially sliding, to a small extent, in a seating made in a support assembly 53 mounted fixedly relative to the plate 11. The reference 55 designates a chamber in which a fluid under pressure, fed via a pipe 57, urges the unit 51 and hence the grinder 23 against the cutting tool 13. The opposite movement, moving the grinder away from the cutting tool, is obtained by means of thrust springs 59 or the equivalent. In this case also, the unit 51 and the support assembly 53 form a single-acting cylinder-piston actuator to move the grinder alternately into and out of operation.

The grinder 21 is subject to the action of a dressing tool 61, mounted to rotate freely by means of bearing 63 on a shaft 65 locked axially to the rod of a short-stroke cylinder-piston actuator designated by 67.

In an analogous manner the grinder 23 is subjected to the action of a dressing tool 71, mounted to rotate freely by means of bearings 73 on a shaft 75 axially locked to the rod of a short-stroke cylinder-piston actuator designated 77. The two dressing tools 61 and 71 act on the respective working surfaces of the associated grinder which comes into contact with the cutting tool 13. These working surfaces are made on discs 21A and 23A, respectively, which possess two symmetrical annular surfaces (21X, 21Y and 23X, 23Y respectively), both produced in abrasive materials. The two discs 21A, 23A may be dismantled, reversed and reinstalled so as to use both annular working surfaces.

The dressing tools 61 and 71 may be moved into contact with the respective grinders 21, 23 when the latter are in contact with the cutting tool 13 and are entrained in rotation by the latter, by means of friction, in the direction indicated by the arrows f21 and f23 respectively. The dressing tools 61 and 71 will in this case also be entrained in rotation by friction by means of the said grinders.

However, in order to allow the dressing of the grinders 21, 23 even when the latter are not in contact with the cutting tool 13, fixed to each grinder 21, 23 is a collar 81, 83 respectively, equipped with vanes 81A and 83A. These vanes intercept the flow of air generated by a respective nozzle, designated 85 for the grinder 21 and 87 for the grinder 23. The two nozzles 85, 87 are oriented so that their flow exerts a force on the sets of vanes 81A, 83A which generates a torque on the grinder associated therewith in the same direction as that exercised by the frictional force of the cutting tool 13 when the respective grinder is pressed against it.

In this manner, if the grinder is not in contact with the cutting tool 13, it can nevertheless be dressed by means of the respective dressing tool 61, 71 by being rotated by the air flow emitted by the associated nozzle. If dressing takes place with the grinder in the active position, in other words pressed against the cutting tool 13, the torque exercised pneumatically by the air jet of the associated nozzle guarantees that the total driving torque is always greater than the resisting torque exercised on the grinder by the associated dressing tool.

The group comprising the grinders 21, 23, the dressing tools 61, 71 and the nozzles 85, 87 is enclosed in a containment housing 91 to which a suction pipe 93 is connected. In the lower part of the housing 91 is a slit 95 having a width slightly greater than the width of the cutting tool 13, which can thus penetrate into the housing 91 and reach the sharpening position between the grinders 21, 23 which act on its two flanks. By means of the suction pipe 93, a vacuum is generated within the housing 91 which aspirates the dust produced during sharpening and during dressing. The suction has sufficient strength to absorb the air flow coming from the nozzles 85, 87. The housing 91 also serves as a containment for the sparks generated during the sharpening phase, which can be a source of a serious fire risk in machines installed in paper converting plants, because of the high flammability of the materials handled and, in particular, the presence of paper dust arising from the cutting action of the tool 13, which dust is readily flammable.

Apart from the advantages mentioned above, when the grinder is caused to rotate by a motor drive and/or by the air system described above, the further advantage is obtained of easy adjustment of the position of the grinder relative to the rotating cutting tool, without the need for visual access to said grinder. Specifically, if the grinder is entrained in rotation by a rotating means even when it is not in contact with the cutting tool, then at the instant at which the grinder—brought progressively nearer to the cutting tool, starting from a position of non-contact—touches the tool, this contact generates a sound that can easily be perceived by the operator. It is thus possible to identify exactly the position at which contact begins between grinder and cutting tool. It is thus possible to obtain a method of sharpening a rotating cutting tool by means of a grinder comprising the following phases: bringing the grinder into a position of non-contact with the cutting tool; causing the grinder to rotate (before or after having positioned it); gradually bringing the grinder closer to the cutting tool and identifying the position at which contact between grinder and cutting tool begins, by means of the sound generated by the contact.

It is understood that the drawing shows only a possible embodiment of the invention, which may vary in shapes and arrangements without thereby departing from the idea underlying the invention.

What is claimed is:

1. A log severing machine for cutting rolls or logs of web material into small rolls, comprising at least one rotating discoidal cutting tool and an associated sharpening device, said sharpening device comprising at least two sharpening grinders located on opposite flanks of said discoidal cutting tool, wherein each grinder of said at least two grinders is provided with a corresponding dressing tool which interacts with said grinder to dress a working surface of said grinder, and wherein each said dressing tool has a first actuator for moving said dressing tool alternately into an active position, in which said dressing tool acts on said grinder, and into an idle position, in which said dressing tool is withdrawn from the grinder.

2. The machine according to claim 1, wherein each of said at least two grinders has a second actuator to move each of the at least two grinders into an active position, in which said grinder acts on the cutting tool, and into an idle position in which said grinder is withdrawn from the cutting tool.

3. The machine according to claim 1, wherein said at least two grinders and each said dressing tool are supported by a common plate.

4. The machine according to claim 2, wherein said at least two grinders and each said dressing tool are supported by a common plate.

5. The machine according to claim 1, 2, 3 or 4, wherein each of said at least two grinders is supported by a respective non-driven shaft.

6. The machine according to claim 1, 2, 3 or 4, further comprising a rotation system associated with said at least two grinders.

7. The machine according to claim 6, further comprising vanes fixed respectively to each of said at least two grinders, wherein said vanes act in response to a jet of air generated by one or more nozzles, said vanes and said one or more nozzles being oriented so as to urge each respective grinder of said at least two grinders to rotate in a common direction as that in which said each respective grinder is urged to rotate by action of the cutting tool when the respective grinder is in said active position.

8. The machine according to claim 1, 2, 3 or 4, wherein said at least two grinders and the respective dressing tool are accommodated in a containment housing, wherein said housing is connected to a suction pipe, and wherein said housing includes a slit into which said cutting tool partially penetrates.

9. A device for sharpening a rotating discoidal cutting tool comprising at least one sharpening grinder and at least one dressing tool which interacts with said at least one grinder to dress a working surface of said at least one grinder, wherein said at least one dressing tool is supported for free rotation and is entrained in rotation by friction by means of a corresponding grinder of said at least one grinder.

10. The device according to claim 9, wherein said at least one grinder has a first actuator to move said at least one grinder into an active position in which said at least one grinder acts on the cutting tool and into an idle position in which said at least one grinder is withdrawn from the cutting tool.

11. The device according to claim 9, wherein said at least one dressing tool has a second actuator to move said at least one dressing tool alternately into an active position, in which said at least one dressing tool acts on said at least one grinder and into an idle position, in which said at least one dressing tool is withdrawn from said at least one grinder.

12. The device according to claim 10, wherein said at least one dressing tool has a second actuator to move said at least one dressing tool alternately into an active position, in which said at least one dressing tool acts on said at least one grinder, and into an idle position, in which said at least one dressing tool is withdrawn from said at least one the grinder.

13. The device according to claim 9, further comprising two grinders and two dressing tools, said two grinders being located on opposite flanks of the cutting tool.

14. The device according to claim 9, wherein said at least one grinder is supported by a non-driven shaft.

15. The device according to claim 9, further comprising a rotation system associated with said at least one grinder.

16. The device according to claim 9, further comprising vanes fixed respectively to said at least one grinder, wherein said vanes act in response to a jet of air generated by one or more nozzles, said vanes and said one or more nozzles being oriented so as to urge each respective grinder of said at least one grinder to rotate in a common direction as that in which said each respective grinder is urged to rotate by action of the cutting tool.

17. The device according to claim 9, wherein said at least one grinder and a respective dressing tool of said at least one dressing tool is accommodated in a containment housing, said housing being connected to a suction pipe, said housing including a slit into which a peripheral portion of said cutting tool partially penetrates, with an axis of said cutting tool being outside said housing.

18. A severing machine for cutting rolls or logs of web material into small rolls, comprising at least one rotating discoidal cutting tool and an associated device for sharpening, wherein said device for sharpening is the device according to claim 9, 10, 11, 13, 14, 15, 16 or 24.

19. A cutting device comprising at least one rotating discoidal cutting tool and an associated device for sharpening said cutting tool, wherein said device for sharpening is the device of claim 9, 10, 11, 12, 13, 14, 15, 16, or 17.

* * * * *

UNITED STATES PATENT AND TRADEMARK OFFICE

CERTIFICATE OF CORRECTION

PATENT NO. : 6,786,808 B1
DATED : September 7, 2004
INVENTOR(S) : Guglielmo Biagiotti It is certified that error appears in the above-identified patent and that said Letters Patent is hereby corrected as shown below:

Column 1,
Line 32, "finished product" should read -- finished product. --

Column 3,
Line 19, "relates to, a cutting" should read -- relates to a cutting --.
Line 48, "roll or log which" should read -- roll or log L which --.
Line 52, "wheel is actuated" should read -- wheel 5 is actuated --.

Column 8,
Line 5, "claim 9, 10, 11, 13, 14, 15, 16 or 24." should read -- claim 9, 10, 11, 12, 13, 14, 15, 16 or 17. --.

Signed and Sealed this

Twenty-first Day of June, 2005

JON W. DUDAS
*Director of the United States Patent and Trademark Office*